US008439662B2

(12) United States Patent
Nakajoh

(10) Patent No.: US 8,439,662 B2
(45) Date of Patent: May 14, 2013

(54) VANE AIR MOTOR

(75) Inventor: Takashi Nakajoh, Tokyo (JP)

(73) Assignee: Nitto Kohki Co., Ltd., Ohta-ku, Tokyo (JP)

( * ) Notice: Subject to any disclaimer, the term of this patent is extended or adjusted under 35 U.S.C. 154(b) by 0 days.

(21) Appl. No.: 13/176,879

(22) Filed: Jul. 6, 2011

(65) Prior Publication Data

US 2011/0262292 A1 Oct. 27, 2011

Related U.S. Application Data

(63) Continuation of application No. PCT/JP2010/050020, filed on Jan. 5, 2010.

(30) Foreign Application Priority Data

Jan. 8, 2009 (JP) ..... 2009-002313

(51) Int. Cl.
*F01C 21/00* (2006.01)
*F03C 2/00* (2006.01)
*F04C 15/00* (2006.01)

(52) U.S. Cl.
USPC ..... 418/270; 418/15; 418/146; 418/259; 418/268

(58) Field of Classification Search ..... 418/15, 418/70, 104, 145, 146, 259, 260–270
See application file for complete search history.

(56) References Cited

U.S. PATENT DOCUMENTS

| | | | | |
|---|---|---|---|---|
| 3,700,363 | A * | 10/1972 | Sorensen et al. | 418/270 |
| 3,827,834 | A * | 8/1974 | Kakimoto | 418/270 |
| 3,901,631 | A * | 8/1975 | Wickham et al. | 418/270 |
| 5,017,109 | A * | 5/1991 | Albert et al. | 418/270 |
| 6,393,837 | B1 | 5/2002 | Tomioka | |
| 7,621,730 | B2 * | 11/2009 | Del Rio et al. | 418/270 |
| 2005/0256512 | A1 * | 11/2005 | Del Rio et al. | 418/270 |

FOREIGN PATENT DOCUMENTS

| | | | |
|---|---|---|---|
| JP | 49-111648 | U | 9/1974 |
| JP | 56-034905 | A | 4/1981 |
| JP | 2001-009695 | A | 1/2001 |
| JP | 2007-535639 | A | 12/2007 |
| WO | WO 2005/110252 | A2 | 11/2005 |

OTHER PUBLICATIONS

International Search Report for International Application No. PCT/JP2010/050020, dated Mar. 23, 2010, 2 pages.
Office Action from counterpart Korean Application No. 2011-7015664, dated Nov. 27, 2012, 8 pages (with translation).

* cited by examiner

*Primary Examiner* — Theresa Trieu
(74) *Attorney, Agent, or Firm* — Brinks Hofer Gilson & Lione

(57) ABSTRACT

A vane air motor configured to prevent uneven wear of vanes is provided. The vane air motor has a cylindrical member having a rotor chamber (19) defined by a circular cylindrical inner peripheral surface (11), and a vaned rotor. A plurality of air discharge openings (50) are provided over a predetermined length range in the axial direction of the rotor chamber. Each pair of axially adjacent air discharge openings are spaced from each other and overlap each other as seen in the circumferential direction of the rotor chamber.

10 Claims, 6 Drawing Sheets

VANE AIR MOTOR

RELATED APPLICATIONS

This application is a continuation of PCT/JP2010/050020 filed on Jan. 5, 2010, which claims priority to Japanese Application No. 2009-002313 filed on Jan. 8, 2009. The entire contents of these applications are incorporated herein by reference.

BACKGROUND OF THE INVENTION

1. Field of the Invention

The present invention relates to a vane air motor usable as driving means for air tools such as pneumatic grinders.

2. Description of the Related Art

A vane air motor has a rotor housing and a vaned rotor. The rotor housing comprises a cylindrical wall having a circular cylindrical inner peripheral surface defining a rotor chamber and end walls provided to close the opposite ends of the cylindrical wall. The vaned rotor is rotatably disposed in the rotor chamber eccentrically with respect to the latter. Compressed air is supplied into the rotor chamber from an air supply opening provided in the cylindrical inner peripheral surface, and the vaned rotor is rotationally driven by the compressed air. The compressed air that has finished rotationally driving of the rotor is discharged to the outside of the rotor chamber from an air discharge opening that opens on the cylindrical inner peripheral surface (Patent Literature 1 noted below).

The rotor has an output shaft portion projecting from one end surface of the rotor along the axis of rotation of the rotor and rotatably supported by one end wall of the motor housing and a support shaft portion projecting from the other end surface of the rotor in coaxial relation to the output shaft portion and rotatably supported by the other end wall of the motor housing. The output shaft portion is drivably connected to a member performing a desired tool function, e.g. polishing, of a pneumatic grinder or other tool concerned. On the other hand, the support shaft portion is, usually, connected to a governor that limits, when the rotor is rotated at a number of revolutions greater than a predetermined one, an air supply flow path for supplying compressed air to an intake hole communicating with the rotor chamber, thereby suppressing the number of revolutions of the rotor. The motor housing and the governor are enclosed by a casing of a pneumatic grinder or other tool to which the vane air motor is attached, and compressed air to be supplied into the rotor chamber is supplied through a compressed air supply chamber formed around the governor by the casing and through the end wall of the motor housing (Patent Literature 2 noted below).

Citation List: Patent Literature:

Patent Literature 1: Japanese Patent Application Publication No. Sho 56-34905

Patent Literature 2: Japanese Patent Application Publication No. 2001-9695

The vanes are each formed in a thin-plate shape, and in response to the rotation of the rotor, the vanes are displaced radially of the rotor and rotate while maintaining sliding engagement with the cylindrical wall surface of the rotor chamber. Therefore, the vanes are subjected to friction, impact associated with displacement, bending stress, and so forth, and hence difficult to use over a long period of time. Accordingly, it is desired to improve the durability of the vanes. However, it is difficult to clarify causes of impairing the vane durability because the vanes are rotated at high speed in the closed rotor chamber, and there has been no satisfactory improvement in durability. The inventor of this application wrestled with this problem and found the following causes of impairing durability.

The first cause is wear of the vane distal edge sliding on the cylindrical wall surface of the rotor chamber. The inventor of this application investigated the matter and found that the wear of the vane distal edge has an effect on the durability of the vane concerned even if the wear is not so large in scale that it is visually discernible. That is, regarding sliding of the vane distal edge on the cylindrical inner peripheral surface of the rotor chamber, because the inner peripheral surface is provided with the air supply opening and the air discharge opening, portions of the vane distal edge that pass across the air supply and discharge openings are less subjected to friction than the rest of the vane distal edge by an amount corresponding to the distance that the above-described portions travel to cross the respective openings, and therefore less worn than the rest of the vane distal edge. The air supply and discharge openings are spaced from each other in the axial direction of the rotor chamber. Therefore, a wear difference occurs between portions of the vane distal edge passing across the respective openings and portions thereof not passing across either of the openings, resulting in the vane distal edge being unevenly worn. In other words, the portions of the vane distal edge passing across the openings become projected, although only slightly, radially outward more than the rest of the vane distal edge, which does not pass across either of the openings. Because the vanes are rotated at high speed, the projecting portions of the vane distal edge hit the edges of the openings, causing large impacts. This interferes with the smooth rotation of the rotor and gives impact to the vane concerned, causing breakage of the vane. Further, the inventor of this application found that the uneven wear of the vane distal edge is mainly caused by the air discharge opening. That is, at a circumferential position where the air supply opening is present, the vane is pressed radially inward by compressed air supplied through the opening, and therefore, the friction between the vane distal edge and the wall surface of the rotor chamber is reduced, whereas, at a circumferential position where the air discharge opening is present, compressed air is discharged from the air discharge opening, and therefore, much larger friction is produced between the vane distal edge and the rotor chamber wall surface than at the position where the air supply opening is present. Consequently, the above-described wear occurs.

In regard to the durability of the vanes, the inventor of this application also noticed the following point: A conventional vane air motor is arranged as follows. Regarding compressed air supplied through an intake hole provided in one end wall of the rotor chamber, a part of the compressed air is supplied into the rotor chamber through air supply openings provided in one end portion of the above-described cylindrical wall that is adjacent to the end wall. The rest of the compressed air is passed through an intake passage extending through the cylindrical wall in the axial direction thereof as far as the other end of the cylindrical wall, and supplied into the rotor chamber through the other air supply openings provided in the other end portion of the cylindrical wall. In such a type of vane air motor, breakage is likely to occur at the above-noted one end portion of the vane distal edge. The inventor of this application found that the cause of the breakage is due to the following matter: In the vane air motor having the above-described structure, a difference in pressure is likely generated between the flows of the compressed air supplied into the rotor chamber from the air supply openings in the one end portion and the other end portion of the cylindrical wall. Accordingly, the opposite ends of the vane are subject to the flows of the compressed air supplied in radially inward from those openings under different pressures. Consequently, the vane is rotated together with the rotor with the distal edge thereof inclined, and the one end portion of the vane distal edge is pressed against the cylindrical wall surface with a stronger force than the other end portion thereof. For this reason, the one end portion of the vane distal edge is likely to become worn. When passing across the above-described air supply openings, in particular, the one end portion of the vane distal edge that is pressed against the cylindrical wall surface hits the peripheral edges of the openings and receives a large impact, resulting in a rupture at the one end portion of the vane distal edge. It is also deemed that the impact applied to the one end portion of the vane distal edge has an effect on the whole vane and causes a rupture at a portion of the vane distal edge other than the end portion thereof.

Further, the inventor of this application found that the following is the reason why wear or breakage is likely to occur at the one end portion of the vane distal edge. The output shaft portion and support shaft portion of the rotor are supported by the respective radial bearings. The radial bearing supporting the support shaft portion is adjacent to the above-described compressed air supply chamber. Therefore, the pressure of compressed air acts on one side (side remote from the rotor chamber) of the radial bearing, causing grease in the radial bearing to leak into the end portion of the rotor chamber. Because grease has a high viscosity, if the grease entering the rotor chamber adheres to the corresponding end portion of a rotating blade, the grease hinders smooth radial movement of the blade relative to the rotor. This may also cause the blade to be inclined and give rise to a problem similar to the above.

Further, the inventor of this application noticed the following: The vanes are each formed in the shape of an elongated plate that is long in the axial direction of the rotor and that has a short width in the radial direction of the rotor. In this regard, the inventor noticed that an axially extending rupture may occur in a vane at a substantially middle position in the width direction, and found that the cause of the rupture is as follows: Each vane is accommodated in a radially extending groove provided on the rotor so as to move radially outward and inward within the groove in response to the rotation of the rotor. Therefore, the side surfaces of the vane slide on the side walls of the groove. In addition, the distal edge of the vane slides on the cylindrical inner peripheral surface of the rotor chamber and therefore encounters resistance to rotation from the cylindrical inner peripheral surface. Consequently, the vane moves outward and inward within the groove while being rotated with a slight inclination in the direction of rotation. Accordingly, a side surface of the vane receives friction from contact with the side wall and edge of the groove, resulting in the vane side surface being scraped, although only slightly. Such a scraped portion of the vane side surface is weak in mechanical strength and readily crackable because the vane is rotated at high speed and subjected to a large impact as stated above. Eventually, a rupture will occur in the scraped portion of the vane side surface.

The inventor of this application found that the above-described causes relate to the durability of the vanes, and that the causes interact with each other to impair the durability of the vanes.

SUMMARY OF THE INVENTION

An object of the present invention is to solve the above-described problems and to improve the durability of the vanes.

The present invention provides a vane air motor comprising a motor housing having a cylindrical wall with a circular cylindrical inner peripheral surface and first and second end walls attached to the opposite ends, respectively, of the cylindrical wall. The motor housing has a rotor chamber therein. The vane air motor further comprises a rotor provided in the motor housing rotatably about an axis of rotation parallel to and spaced from the center axis of the cylindrical inner peripheral surface. The rotor has an output shaft portion extending through the second end wall along the axis of rotation and a support shaft portion extending into the first end wall. Further, the vane air motor comprises vanes fitted to the rotor. Compressed air is supplied into the rotor chamber to rotationally drive the rotor by the compressed air. The compressed air that has finished rotationally driving the rotor is discharged to the outside of the rotor chamber from a plurality of air discharge openings that open on the cylindrical inner peripheral surface. The plurality of air discharge openings are spaced from each other such that each pair of air discharge openings adjacent to each other in the axial direction of the motor housing overlap each other as seen in the circumferential direction of the motor housing.

That is, in this vane air motor, the air discharge openings, which have heretofore constituted the cause of uneven wear of the vane distal edge, are disposed to overlap each other as seen in the circumferential direction as stated above, thereby allowing wear to occur evenly over a predetermined length range where the air discharge openings are disposed, and thus solving the above-described problems with the conventional vane air motor.

In the vane air motor, the plurality of air discharge openings may be disposed to overlap each other as seen in the axial direction. With this structure, the amount of air discharged can be changed even more continuously.

The air discharge openings may be circular in shape to facilitate formation of the air discharge openings and to reduce the lowering of strength of the cylinder caused by providing the air discharge openings.

A specific layout of the air discharge openings may be as follows. The air discharge openings comprise a central air discharge opening and a plurality of air discharge openings disposed at each side of the central air discharge opening in the axial direction. The air discharge openings at each side of the central air discharge opening are arranged such that the distance of the air discharge openings from the central air discharge opening increases toward the upstream side of the direction of rotation of the rotor as the distance from the central air discharge opening increases in the axial direction.

An additional air discharge opening may be provided for adjusting the amount of air to be discharged.

The above-described vane air motor may further comprise first and second radial bearings attached to the first and second end walls, respectively, to rotatably support the support shaft portion and the output shaft portion, respectively, and a casing contiguously joined to the motor housing to form a compressed air supply chamber together with the first end wall to supply compressed air into the rotor chamber through an air supply hole formed in the first end wall. The first end wall has an end wall portion having an inner end surface abutting against an end surface of the cylindrical wall to define the rotor chamber together with the cylindrical inner peripheral surface of the cylindrical wall and an outer end surface opposite to the inner end surface in the axial direction of the rotor. The end wall portion further has a circular cylindrical hole extending through the first end wall to receive the support shaft portion of the rotor therethrough. The first end wall further has a circular cylindrical wall portion extending from the outer end surface into the compressed air supply chamber opposite to the rotor chamber and defining a bearing-housing recess housing the first radial bearing. The cylindrical wall portion has an inner peripheral surface to which an outer peripheral surface of an outer race of the first radial bearing is fitted and secured. The first radial bearing comprises the outer race, an inner race fitted and secured to an outer peripheral surface of the support shaft portion in coaxial relation to the outer race, and a plurality of rolling members provided between the outer race and the inner race. The first end wall has a communication groove extending from an end surface of the cylindrical wall portion to the outer end surface of the end wall portion along the inner peripheral surface of the cylindrical wall portion.

In this vane air motor, a communication groove is provided to extend from an end surface of the cylindrical wall portion to the outer end surface of the end wall portion along the inner peripheral surface of the cylindrical wall portion. Therefore, the air pressure in the compressed air supply chamber is transmitted as far as the side of the radial bearing closer to the rotor chamber through the communication groove, so that a substantially uniform air pressure acts on both the front and rear of the radial bearing (i.e. both sides of the radial bearing that are closer to the rotor chamber and the compressed air supply chamber, respectively), thereby making it possible to prevent the above-described leakage of grease from the radial bearing into the rotor chamber. Thus, it is possible to prevent the above-described problem that grease adheres to the end portion of a vane and causes the vane to be inclined, resulting in that only one end of the vane distal edge slides against the cylindrical wall surface of the rotor chamber and is eventually worn excessively or broken.

Specifically, the outer end surface of the end wall portion may have a communication recess communicating with the communication groove. The communication recess is disposed opposite the radial bearing. More specifically, the communication recess may have an annular recess formed on the outer end surface of the end wall portion around the cylindrical hole, and a radial recess formed on the outer end surface of the end wall portion to extend radially from the annular recess to communicate with the communication groove. The purpose of this structure is to surely transmit the air pressure to the side of the radial bearing closer to the rotor chamber and to prevent the above-described leakage of grease.

The vane air motor according to the present invention may comprise, in addition to the above-described constituent elements, a governor having a shaft-shaped rotating member secured to an end of the support shaft portion in coaxial relation thereto to rotate together with the support shaft portion. When the shaft-shaped rotating member is rotated at a number of revolutions higher than a predetermined one, the governor limits an air supply flow path supplying compressed air to the air supply hole of the motor housing to suppress the number of revolutions of the rotor. The shaft-shaped rotating member of the governor may have a flange extending radially of the shaft-shaped rotating member. The flange has an annular surface placed in close proximity to an end surface of the outer race remote from the rotor chamber. With this structure, when the shaft-shaped rotating member of the governor rotates in response to the rotation of the rotor, the flange rotates in close proximity to the outer race. Therefore, it is possible to prevent the air pressure of compressed air in the compressed air supply chamber from acting directly between the inner and outer races of the radial bearing, and hence possible to reduce the above-described leakage of grease.

Further, in the present invention having the above-described structure, the end wall portion of the first end wall may have a radial hole extending through the end wall portion radially outward from the wall surface of the cylindrical hole and opening on the outer peripheral surface of the end wall portion to communicate with the atmosphere. With this structure, even if grease leaks from the radial bearing toward the rotor chamber, the grease can be discharged to the outside before reaching the rotor chamber.

Further, in the above-described vane air motor, an air supply opening for supplying compressed air into the rotor chamber may be provided to open on the cylindrical inner peripheral surface at a substantially central position in the axial direction of the cylindrical wall. This structure makes it possible to avoid the above-described inclination of the vanes due to the pressure difference of compressed air blown into the rotor chamber in a case where air supply openings are provided at the opposite ends of the cylindrical wall of the rotor chamber, thereby making it possible to reduce the uneven wear of the vane.

In addition, the present invention provides a vane air motor comprising a motor housing having a cylindrical wall with a circular cylindrical inner peripheral surface and first and second end walls attached to the opposite ends, respectively, of the cylindrical wall. The motor housing has a rotor chamber therein. The vane air motor further comprises a rotor provided in the motor housing rotatably about an axis of rotation parallel to and spaced from the center axis of the cylindrical inner peripheral surface. The rotor has an output shaft portion extending through the second end wall along the axis of rotation and a support shaft portion extending into the first end wall. Further, the vane air motor comprises vanes fitted to the rotor. Compressed air is supplied into the rotor chamber to rotationally drive the rotor by the compressed air. The compressed air that has finished rotationally driving the rotor is discharged to the outside of the rotor chamber from a plurality of air discharge openings opening on the cylindrical inner peripheral surface. The vane air motor further comprises first and second radial bearings attached to the first and second end walls, respectively, to rotatably support the support shaft portion and the output shaft portion, respectively, and a casing contiguously joined to the motor housing to form a compressed air supply chamber together with the first end wall to supply compressed air into the rotor chamber through the first end wall. The first end wall has an end wall portion having an inner end surface abutting against an end surface of the cylindrical wall to define the rotor chamber together with the cylindrical inner peripheral surface of the cylindrical wall and an outer end surface opposite to the inner end surface in the axial direction of the rotor. The end wall portion further has a circular cylindrical hole extending through the first end wall to receive the support shaft portion of the rotor therethrough. The first end wall further has a circular cylindrical wall portion extending from the outer end surface into the compressed air supply chamber opposite to the rotor chamber and defining a bearing-housing recess housing the first radial bearing. The cylindrical wall portion has an inner peripheral surface to which an outer peripheral surface of an outer race of the first radial bearing is fitted and secured. The first radial bearing comprises the outer race, an inner race fitted and secured to an outer peripheral surface of the support shaft portion in coaxial relation to the outer race, and a plurality of rolling members provided between the outer race and the inner race. The first end wall has a communication groove extending from an end surface of the cylindrical wall portion to the outer end surface of the end wall portion along the inner peripheral surface of the cylindrical wall portion. The air discharge openings are disposed such that each pair of air discharge openings adjacent to each other in the axial direction overlap each other as seen in the circumferential direction of the motor housing. An air supply opening for supplying compressed air into the rotor chamber is provided to open on the cylindrical inner peripheral surface at a substantially central position in the axial direction of the cylindrical wall.

In this vane air motor, an air supply opening is provided to open on the cylindrical inner peripheral surface of the rotor chamber at a substantially central position of the cylindrical wall. Therefore, it is possible to avoid the inclination of the vanes that is caused by compressed air supplied from air supply openings provided in the axially opposite end portions, respectively, of the rotor chamber as in the above-described conventional vane air motor. Further, the provision of the above-described communication groove makes it possible to apply the pressure of compressed air equally to the axially opposite ends of the first radial bearing and hence possible to avoid the problem that grease is pushed out from the first radial bearing into the rotor chamber to contact a vane, causing the vane to be inclined, which has heretofore occurred in the conventional vane air motor. That is, it becomes possible to reduce wear or breakage at an end portion of the vane distal edge, which results from the vane being rotated in an inclined position. Meanwhile, when the vanes are rotated without being inclined, uneven wear is likely to occur at the vane distal edge in relation to the air discharge openings. In this regard, in the present invention, the air discharge openings are provided so as to overlap each other in the circumferential direction, thereby making it possible to reduce the uneven wear. Thus, this vane air motor has eliminated the causes of wear and breakage of the vanes, which have been experienced with the conventional motors, thereby enabling the durability of the vanes to be improved to a considerable extent.

An embodiment of the vane air motor according to the present invention will be explained below with reference to the accompanying drawings.

DETAILED DESCRIPTION OF THE PREFERRED EMBODIMENTS

Figure 1:
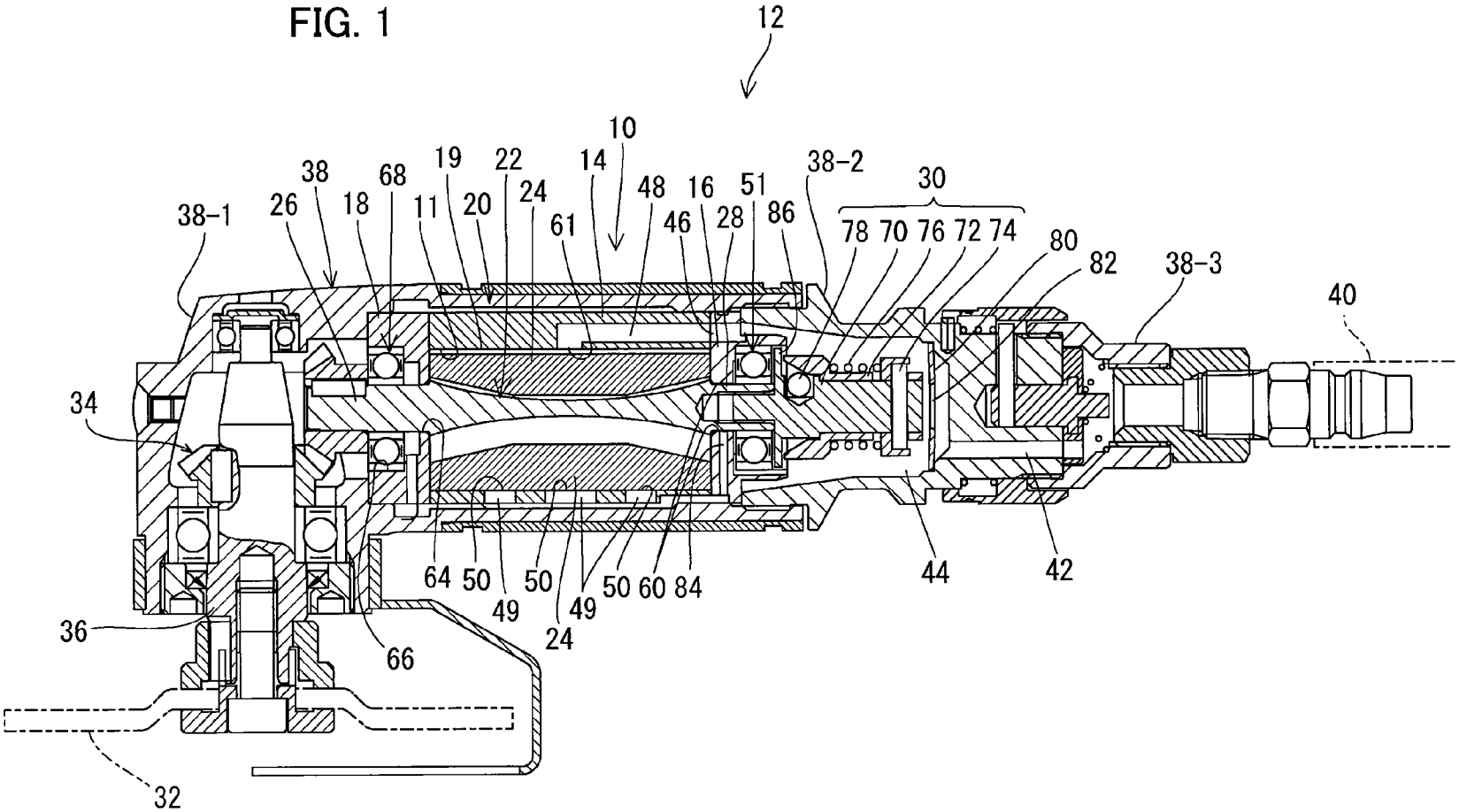
FIG. 1 is a longitudinal sectional side view of a vane air motor according to the present invention.

FIG. 1 shows a pneumatic grinder (polishing machine) 12 having a vane air motor 10 according to the present invention.

The vane air motor 10 has a motor housing 20 having a cylindrical wall 14 with a circular cylindrical inner peripheral surface 11 and first and second end walls 16 and 18 provided at the opposite ends, respectively, of the cylindrical wall 14. The motor housing 20 has a rotor chamber 19 formed therein. The vane air motor 10 further has a rotor 22 eccentrically provided in the rotor chamber 19, a plurality of vanes 24 fitted to the rotor 22, and a support shaft portion 28 and an output shaft portion 26 that extend from the opposite ends of the rotor 22 along the axis of rotation of the rotor 22 and that are supported by the first and second end walls 16 and 18, respectively. A governor 30 is attached to an end of the support shaft portion 28. The output shaft portion 26 is drivably connected to a rotating shaft 36 of a disk-shaped abrasive member 32 through a bevel gear 34.

The rotating shaft 36, the vane air motor 10 and the governor 30 are housed in a casing 38 of the pneumatic grinder 12. The casing 38 comprises a plurality of casing parts 38-1 to 38-3. The casing part 38-3 receives compressed air through a hose 40 connected to an air pump (not shown). The received compressed air is supplied into a compressed air supply chamber 44 through a communicating hole 42 extending through the casing part 38-2. The compressed air supply chamber 44 is formed around the governor 30 by the casing part 38-2 and the first end wall 16. The compressed air is further supplied into the rotor chamber 19 through air supply holes 46 and 48 provided through the upper position (as seen in the figure) of the first end wall 16 and the cylindrical wall 14, respectively, to act on the vanes 24, thereby causing the rotor 22 to rotate, and thus rotationally driving the abrasive member 32. The compressed air having acted on the vanes 24 is discharged to the outside of the casing 38 through exhaust holes 49 and an exhaust passage (not shown) provided in the casing.

One feature of the vane air motor according to the present invention resides in the layout of air discharge openings 50 of the exhaust holes 49 that are provided in the cylindrical wall 14 of the rotor housing 20 to open into the rotor chamber 19. The layout of the air discharge openings 50 will be explained with reference to FIGS. 2 and 3. It should be noted that, in FIG. 1, the air supply holes 48 and the exhaust holes 49 are drawn to oppose each other in the diametrical direction for the sake of illustration. In actuality, as will be understood from FIG. 2, there are provided a plurality of air supply holes 48 spaced from each other in the circumferential direction of the cylindrical wall 14, and a plurality of exhaust holes 49 are provided at respective positions displaced from positions diametrically opposing the air supply holes 48. The air supply holes 48 are communicated with the rotor chamber 19 through one mutual air supply opening 61 (FIG. 1) provided to extend in the circumferential direction at a substantially central position in the axial direction of the cylindrical wall 14.

Figure 2:
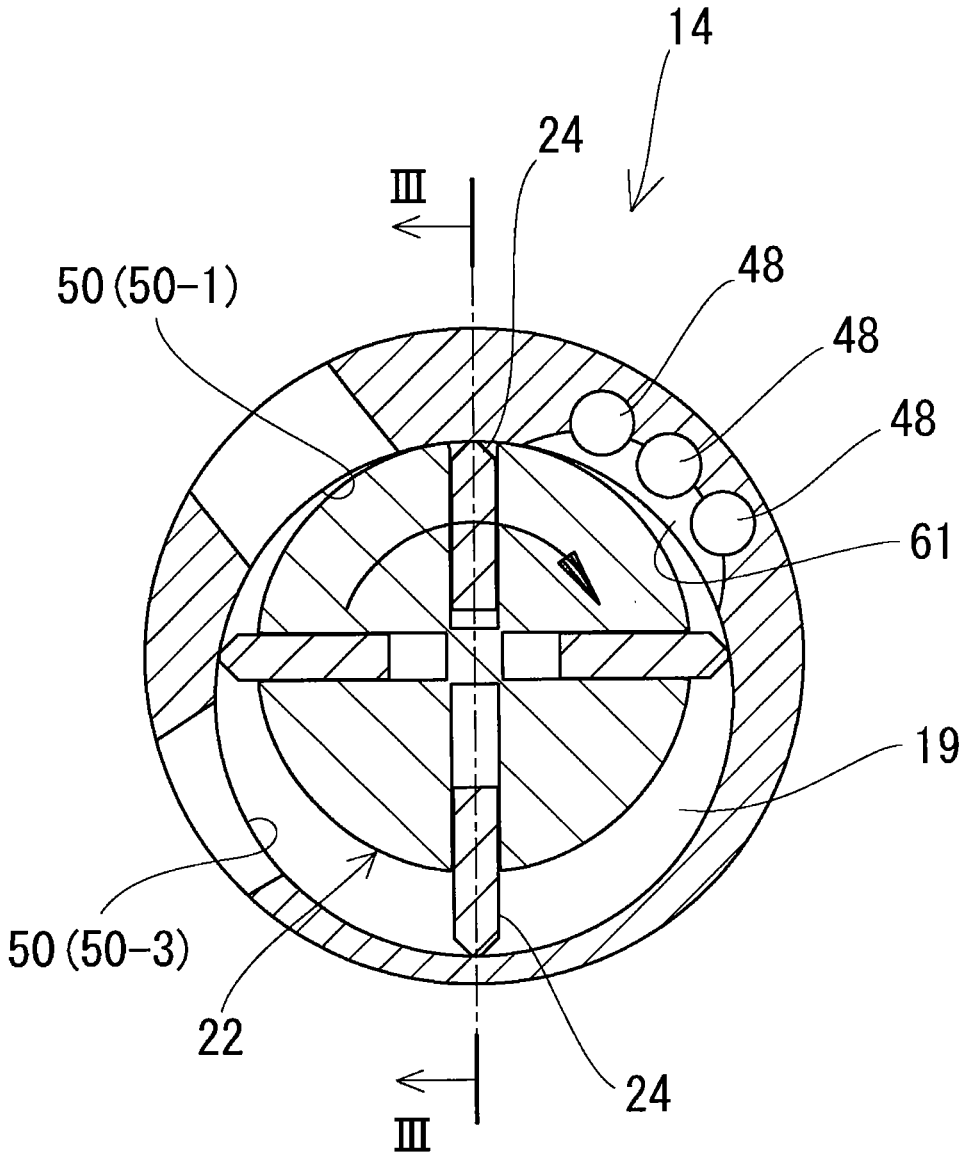
FIG. 2 is a sectional view as seen along the line II-II in FIG. 3.
Figure 3:
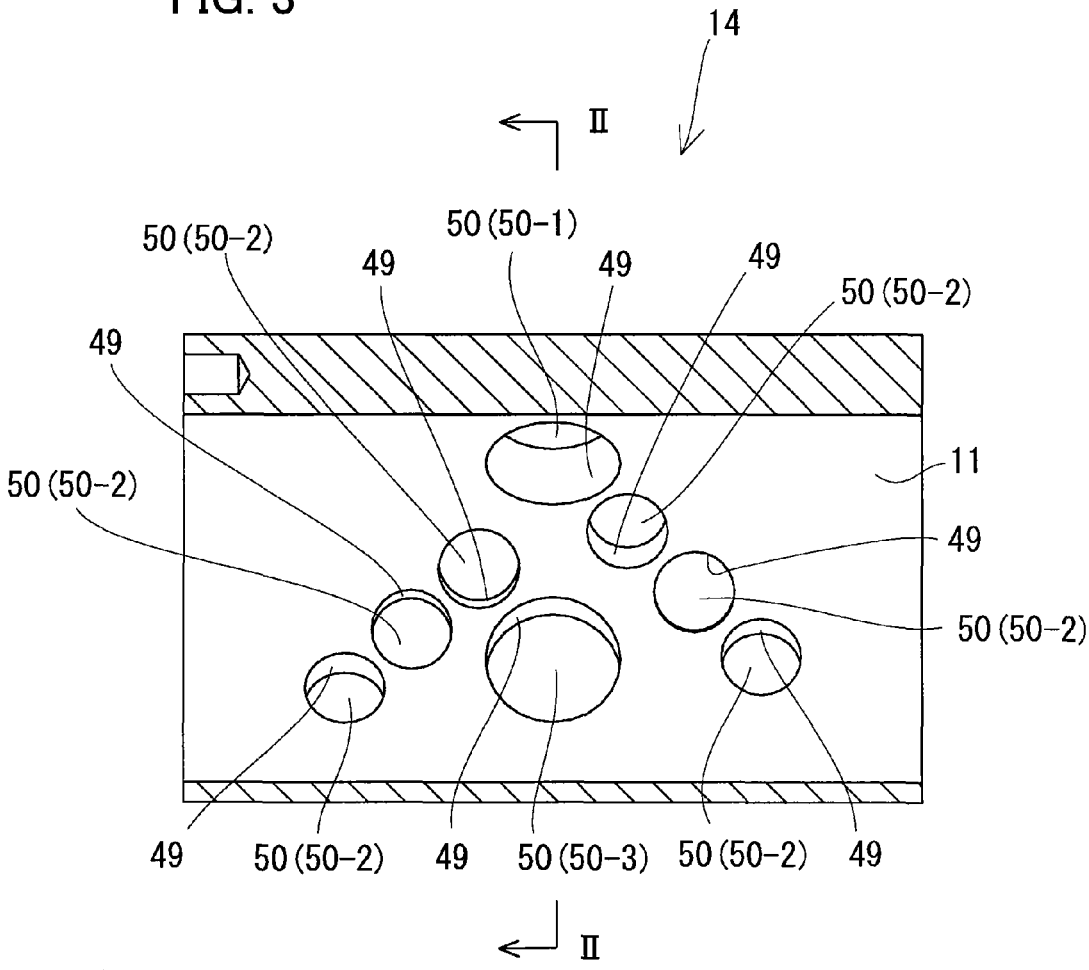
FIG. 3 is a sectional view as seen along the line in FIG. 2.

The air discharge openings 50 of the exhaust holes 49 are provided in the left half of the cylindrical wall 14 as seen in FIG. 2, not in a substantially right half of the cylindrical wall 14 where the air supply opening 61 is provided. As shown in FIG. 3, the air discharge openings 50 include a large-diameter air discharge opening 50-1 that is provided at a position that is substantially the center in the axial direction of the cylindrical wall 14 and that is an upper position as seen in FIG. 3, and three small-diameter air discharge openings 50-2 that are disposed at each of the left and right sides of the air discharge opening 50-1. Thus, the air discharge openings 50 are arranged in an inverted V shape as a whole. Further, an additional large-diameter air discharge opening 50-3 is formed at a central and lower position as seen in FIG. 3.

An important point of the layout of the air discharge openings 50 is that each pair of air discharge openings 50 adjacent to each other in the axial direction of the cylindrical wall 14 are spaced from each other but disposed to overlap each other as seen in the circumferential direction of the cylindrical wall 14. Thus, the air discharge openings 50 are, as seen in the circumferential direction, provided continuously over a predetermined length range in the axial direction of the rotor chamber 19. In short, the above-described layout of the air discharge openings 50 makes it possible that the vane distal edge are evenly worn over the predetermined length range.

Further, in the illustrated embodiment, a plurality of air discharge openings 50 are also disposed to overlap each other as seen in the axial direction. The purpose of this arrangement is to smoothly vary the overall opening area of air discharge openings 50 through which compressed air having finished rotationally driving the rotor 22 passes when it is discharged as the vanes rotate.

In addition, the present invention has the following feature.

Figure 4:
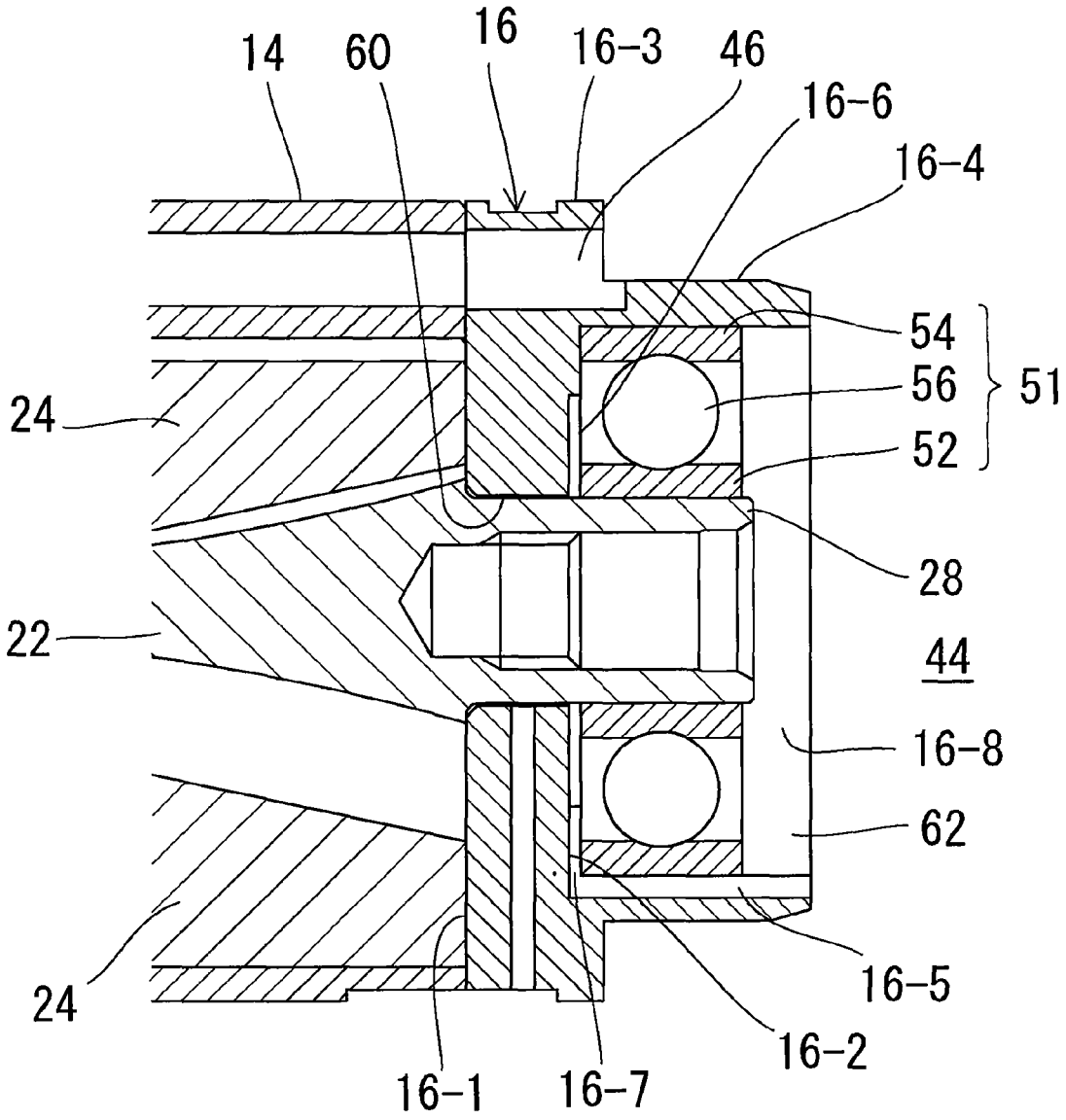
FIG. 4 is an enlarged sectional side view of a first end wall having a radial bearing installed therein.

The first end wall 16 is, as shown clearly in FIG. 4, provided with a circular cylindrical hole 60 communicating with the rotor chamber 19 and receiving the support shaft portion 28 therethrough and a bearing-housing recess 62 formed contiguous with the cylindrical hole 60 at the side of the first end wall 16 remote from the rotor chamber 19. A radial bearing 51 is disposed in the bearing-housing recess 62. The radial bearing 51 has an inner race 52 secured around the support shaft portion 28, an outer race 54 secured in the bearing-housing recess 62 at a position radially outward of the inner race 52, and bearing balls 56 provided between the inner race 52 and the outer race 54. The radial bearing 51 rotatably supports the support shaft portion 28. Similarly, the second end wall 18 has a circular cylindrical hole 64 receiving the output shaft portion 26 therethrough, a bearing-housing recess 66, and a radial bearing 68.

As shown in FIG. 1, the governor 30 has a shaft-shaped rotating member 70 coaxially secured to the end of the support shaft portion 28, a sleeve 72 slidably provided around the shaft-shaped rotating member 70, a pin 74 provided to extend diametrically through the sleeve 72 and the shaft-shaped rotating member 70, a coil spring 76 provided between the pin 74 and the sleeve 72 to urge the sleeve 72 leftward as seen in the figure, and a ball 78 housed in a radial hole formed in the shaft-shaped rotating member 70. The ball 78 is engaged with a tapered surface of the sleeve 72 and pressed radially by the urging force of the coil spring 76. When the rotor 20 is rotated at a number of revolutions greater than a predetermined one and, consequently, the shaft-shaped rotating member 70 is rotated together with the rotor 20, the ball 78 moves radially outward by centrifugal force, thus urging the tapered surface of the sleeve 72 to displace the sleeve 72 rightward as seen in the figure. A coned disk spring 80 is disposed at a position adjacent to a right-end surface of the shaft-shaped rotating member 70 so as to cross the compressed air supply chamber 44 near the right end of the supply chamber. The coned disk spring 80 has an air inlet hole 82 formed in the center thereof to introduce compressed air passed through a communicating hole 42 of the casing part 38-2 into the compressed air supply chamber 44. When the sleeve 72 is displaced rightward as stated above, the sleeve 72 closes the air inlet hole 82 of the coned disk spring 80 to suppress the supply of compressed air into the rotor chamber 19, thereby suppressing the rotation of the rotor 22. The shaft-shaped rotating member 70 of the governor 30 has a flange 86 extending radially of the rotating member 70. A surface of the flange 86 that faces the radial bearing 51 is placed in close proximity to an end surface of the outer race 54 of the radial bearing 51 so that the pressure of compressed air in the compressed air supply chamber 44 acts on the inside of the radial bearing 51 after the pressure has been reduced, thereby suppressing grease in the radial bearing 51 from being pushed out toward the rotor chamber 19.

In the present invention, the end wall 16 is configured as stated below to prevent grease in the radial bearing 51 from being pushed out toward the rotor chamber 19 by the effect of compressed air in the compressed air supply chamber 44.

Figure 5:
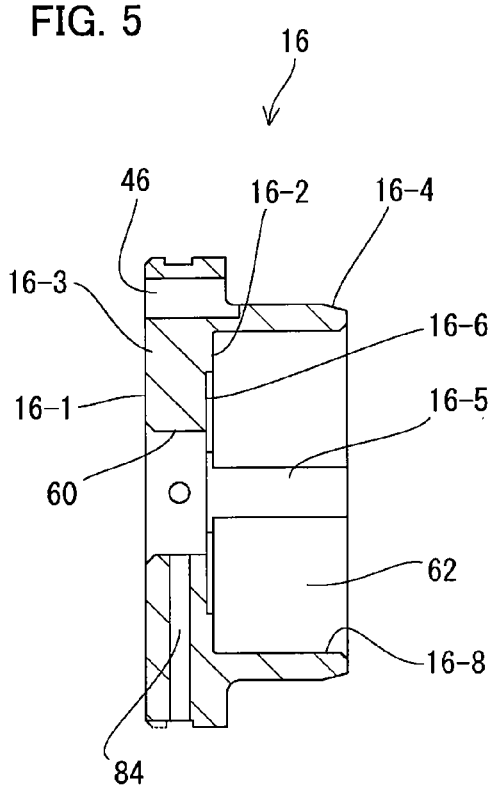
FIG. 5 is a sectional side view of the first end wall defining a rotor chamber of the vane air motor shown in FIG. 1.
Figure 6:
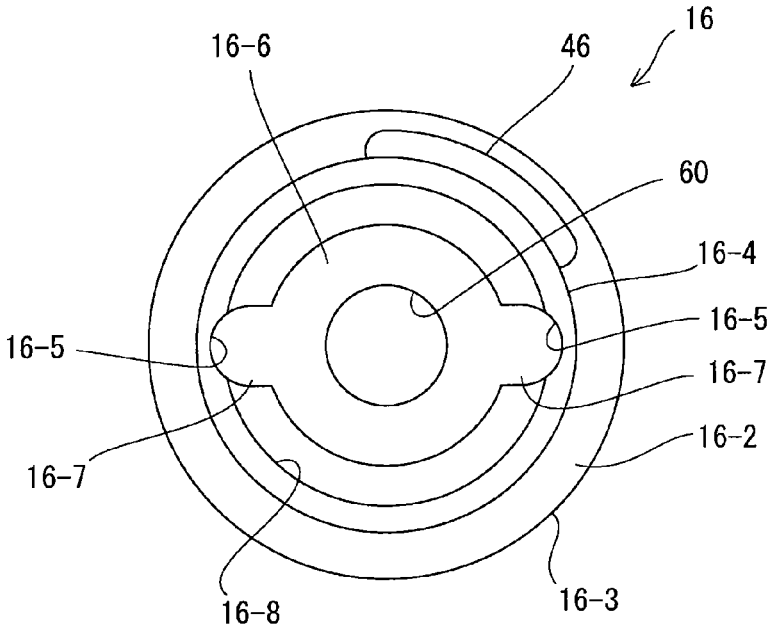
FIG. 6 is an end view of the first end wall shown in FIG. 5.

As shown in FIGS. 5 and 6, the first end wall 16 has an end wall portion 16-3 having an inner end surface 16-1 abutting against the end surface of the cylindrical wall 14 to define the rotor chamber 19 together with the cylindrical inner peripheral surface of the cylindrical wall 14. The end wall portion 16-3 further has an outer end surface 16-2 opposite to the inner end surface 16-1. Further, the first end wall 16 has a cylindrical wall portion 16-4 extending axially from the end wall portion 16-3 to define the bearing-housing recess 62. The first end wall 16 has communication grooves 16-5 extending from the end surface of the cylindrical wall portion 16-4 to the outer end surface 16-2 of the end wall portion 16-3 along the inner peripheral surface of the cylindrical wall portion 16-4. The communication grooves 16-5 allow the air pressure in the compressed air supply chamber 44 to be transmitted to the side of the radial bearing 51 closer to the rotor chamber 19. In the present invention, the first end wall 16 further has an annular recess 16-6 and a pair of radial recesses 16-7 formed on the outer end surface 16-2 of the end wall portion 16-3. The annular recess 16-6 is formed around the cylindrical hole 60. The radial recesses 16-7 extend radially from the annular recess 16-6 to communicate with the communication grooves 16-5, respectively.

With the above-described structure, the air pressure in the compressed air supply chamber 44 is allowed to act on both the front and rear of the radial bearing 51 (i.e. both sides of the radial bearing 51 that are closer to the rotor chamber 19 and the compressed air supply chamber 44, respectively), thereby suppressing grease from being pushed out of the radial bearing 51 toward the rotor chamber 19.

In the present invention, the first end wall 16 is further provided with a radial hole 84 extending radially from the cylindrical hole 60 of the end wall portion 16-3 and opening on the outer peripheral surface of the end wall portion 16-3. Grease that may be pushed out slightly from the radial bearing 51 flows out through the radial hole 84 to the outside of the cylindrical wall 14 having the rotor chamber 19.

The vane air motor 10 according to the present invention, which has the above-described structure, can prevent leakage of grease from the radial bearing into the rotor chamber, which has been experienced with the conventional vane air motor.

Figure 7:
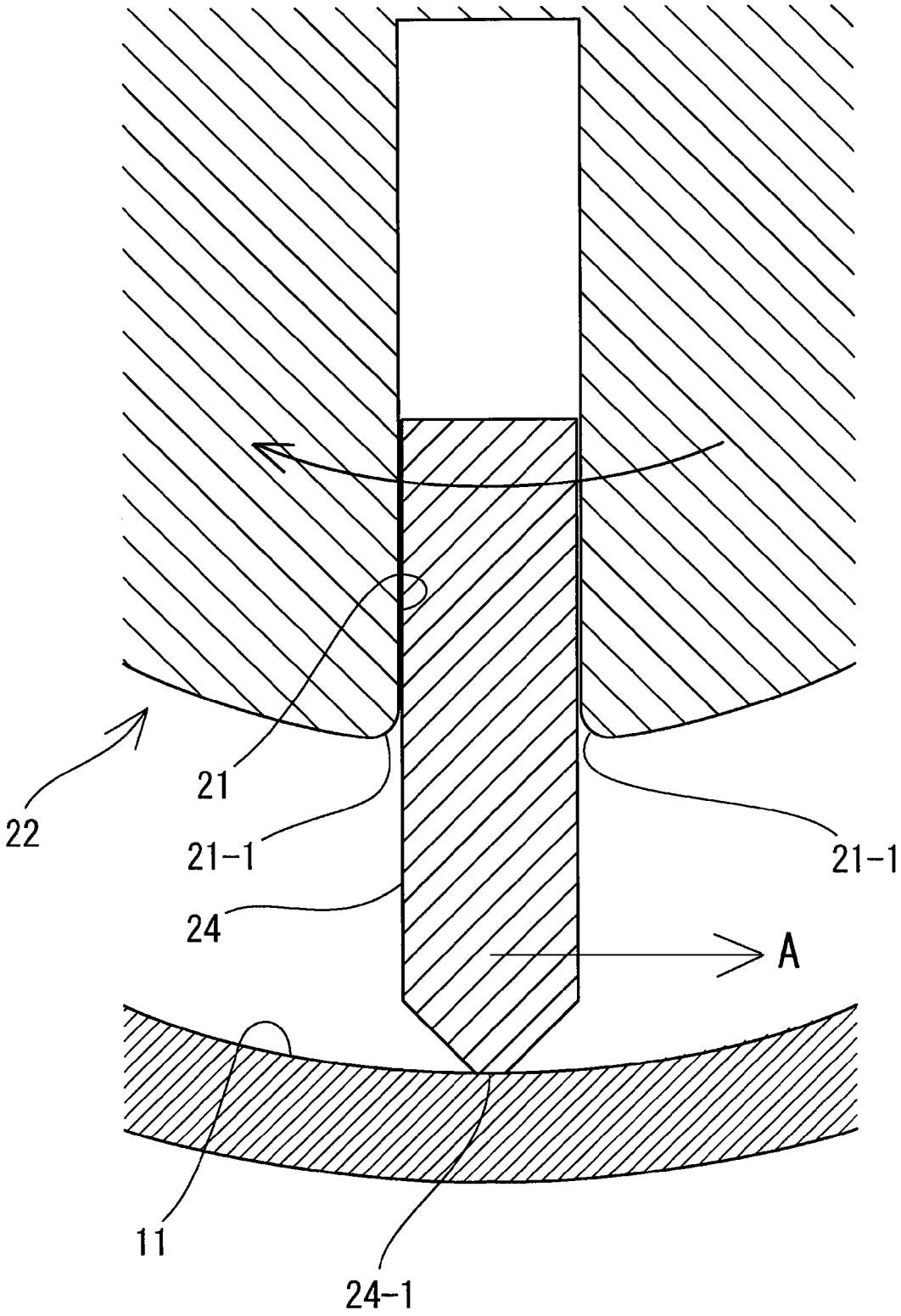
FIG. 7 is a fragmentary enlarged sectional view showing a vane of the vane air motor in FIG. 1 and a vane-accommodating groove formed in a rotor to house the vane.

Further, in the present invention, as shown in FIG. 7, opening edges 21-1 of each vane-accommodating groove 21 formed in the rotor 22 are rounded off in order to improve the durability of the vane. That is, as the rotor 22 rotates, the vane 24 rotates with the distal edge 24-1 sliding on the cylindrical inner peripheral surface 11 of the rotor housing. Therefore, a force shown by the arrow A acts on the vane 24. For this reason, the vane 24 moves radially outward and inward within the vane-accommodating groove 21 in the state of being inclined in the direction of rotation, although only slightly. Accordingly, one side surface of the vane 24 slides while being pressed against the associated opening edge 21-1 of the vane-accommodating groove 21. As a result, the side surface of the vane 24 is worn and scraped, although only slightly. Such a scraped portion of the vane 24 is readily crackable under the influence of impact applied to the vane 24 by rotation. In the invention of this application, the opening edges 21-1 are rounded off to reduce such scraping due to wear. Further, in this embodiment, the wall surfaces of the vane-accommodating groove 21 are mirror-finished surfaces or other similar surfaces. This structure allows smooth movement of the vane 24 when sliding on the wall surfaces of the vane-accommodating groove 21 and reduces the impact that may be applied to the vane 24 owing to non-smooth movement of the vane 24, thereby reducing the causes of vane breakage.

With the vane air motor according to the foregoing embodiment of the present invention, the air supply opening 61 is provided to open on the cylindrical inner peripheral surface of the rotor chamber 19 at a substantially central position of the cylindrical wall 14. Therefore, it is possible to avoid inclination of the vanes that would otherwise be caused by compressed air supplied from air supply openings provided in the axially opposite end portions, respectively, of the rotor chamber as in the above-described conventional vane air motor. Further, the provision of the communication grooves 16-5 makes it possible to apply the pressure of compressed air equally to the axially opposite ends of the first radial bearing and hence possible to avoid the problem that grease is pushed out from the first radial bearing into the rotor chamber to contact a vane, thus causing the vane distal edge to be inclined, which has heretofore occurred in the conventional vane air motor. That is, it becomes possible to reduce wear or breakage of an end portion of the vane distal edge, which results from the vane being rotated in an inclined position. Meanwhile, when the vane is rotated without being inclined, uneven wear is likely to occur at the vane distal edge in relation to the air discharge openings 50. In this regard, in the present invention, the air discharge openings are provided so as to overlap each other as seen in the circumferential direction, thereby making it possible to reduce the uneven wear. Further, the opening edges of the vane-accommodating grooves are rounded off, and the wall surfaces of the vane-accommodating grooves are formed by smooth surfaces, thereby further reducing wear of and impact to the vanes caused by rotation. Thus, the vane air motor of the present invention has eliminated the causes of wear and breakage of the vanes, which have been experienced with the conventional motors owing to various factors, thereby enabling the durability of the vanes to be improved to a considerable extent.

Although one embodiment of the present invention has been described above, the present invention is not limited to the described embodiment but can be modified in a variety of ways. Regarding the layout of the air discharge openings, for example, the air discharge openings only need to be disposed to overlap one another as seen in the circumferential direction of the cylindrical wall 14 and do not necessarily need to be arranged in an inverted V shape as illustrated in the figure.

What is claimed is:

1. A vane air motor comprising:

a motor housing comprising a cylindrical wall having a circular cylindrical inner peripheral surface, and a first end wall and a second end wall that are attached to opposite ends, respectively, of the cylindrical wall, the motor housing having a rotor chamber therein;

a rotor disposed in the motor housing rotatably about an axis of rotation parallel to and spaced from a center axis of the circular cylindrical inner peripheral surface, the rotor comprising an output shaft portion extending through the second end wall along the axis of rotation, the rotor further comprising a support shaft portion extending into the first end wall; and vanes fitted to the rotor;

wherein compressed air is supplied into the rotor chamber to rotationally drive the rotor by the compressed air, and the compressed air that has finished rotationally driving the rotor is discharged to an outside of the rotor chamber from a plurality of air discharge openings that open on the circular cylindrical inner peripheral surface;

wherein the plurality of air discharge openings comprise a central air discharge opening that is central in the axial direction and a plurality of air discharge openings disposed at each side of the central air discharge opening in the axial direction, the air discharge openings at each side of the central air discharge opening being arranged such that a distance of the air discharge openings from the central air discharge opening increases toward an upstream side of a direction of rotation of the rotor as a distance from the central air discharge opening increases in the axial direction, the plurality of air discharge openings being spaced from each other such that each pair of the air discharge openings adjacent to each other in an axial direction of the motor housing overlap each other as seen in a circumferential direction of the motor housing and in the axial direction.

2. The vane air motor of claim 1, wherein the air discharge openings are circular in shape.

3. The vane air motor of claim 2, wherein an additional air discharge opening is disposed upward and spaced apart from the central air discharge opening and between the plurality of air discharge openings disposed at each side of the central air discharge opening in the axial direction, the additional air discharge opening is circular in shape and open on the circular cylindrical inner peripheral surface.

4. The vane air motor of claim 2, further comprising:

a first radial bearing and a second radial bearing that are attached to the first end wall and the second end wall, respectively, to rotatably support the support shaft portion and the output shaft portion, respectively; and a casing joined to the motor housing to form a compressed air supply chamber together with the first end wall to supply compressed air into the rotor chamber through an air supply hole formed in the first end wall;

the first end wall having:

an end wall portion having an inner end surface abutting against an end surface of the cylindrical wall to define the rotor chamber together with the circular cylindrical inner peripheral surface of the cylindrical wall, an outer end surface opposite to the inner end surface in an axial direction of the rotor, and a circular cylindrical hole through which the support shaft portion of the rotor passes to extend through the first end wall; and a circular cylindrical wall portion extending from the outer end surface into the compressed air supply chamber opposite to the rotor chamber and defining a bearing-housing recess housing the first radial bearing, the circular cylindrical wall portion having an inner peripheral surface to which an outer peripheral surface of an outer race of the first radial bearing is securely fitted, the first radial bearing comprising the outer race, an inner race securely fitted to an outer peripheral surface of the support shaft portion in coaxial relation to the outer race, and a plurality of rolling members provided between the outer race and the inner race;

the first end wall having a communication groove extending from an end surface of the circular cylindrical wall portion to the outer end surface of the end wall portion along the inner peripheral surface of the circular cylindrical wall portion.

5. The vane air motor of claim 4, wherein the outer end surface of the end wall portion has a communication recess communicating with the communication groove, the communication recess being disposed opposite the radial bearing.

6. The vane air motor of claim 5, wherein the communication recess comprises an annular recess formed on the outer end surface of the end wall portion around the circular cylindrical hole, and a radial recess formed on the outer end surface to extend radially from the annular recess to communicate with the communication groove.

7. The vane air motor of claim 4, further comprising:

a governor comprising a shaft-shaped rotating member secured to an end of the support shaft portion in coaxial relation to the support shaft portion to rotate together with the support shaft portion, wherein, when the shaft-shaped rotating member is rotated at a number of revolutions greater than a predetermined one, the governor limits an air supply flow path supplying compressed air to the air supply hole of the motor housing to suppress the number of revolutions of the rotor;

the shaft-shaped rotating member of the governor having a flange extending radially of the shaft-shaped rotating member, the flange having an annular surface placed in close proximity to an end surface of the outer race remote from the rotor chamber.

8. The vane air motor of claim 4, wherein the end wall portion of the first end wall has a radial hole extending through the end wall portion radially outward from a wall surface of the circular cylindrical hole and opening on an outer peripheral surface of the end wall portion to communicate with atmosphere.

9. The vane air motor of claim 4, wherein the cylindrical wall comprises an air supply opening for supplying compressed air into the rotor chamber, wherein the air supply opening opens on the circular cylindrical inner peripheral surface of the cylindrical wall at a substantially central position in the axial direction of the cylindrical wall.

10. A vane air motor comprising:

a motor housing comprising a cylindrical wall having a circular cylindrical inner peripheral surface and a first end wall and a second end wall that are attached to opposite ends, respectively, of the cylindrical wall, the motor housing having a rotor chamber therein;

a rotor provided in the motor housing rotatably about an axis of rotation parallel to and spaced from a center axis of the circular cylindrical inner peripheral surface, the rotor having an output shaft portion extending through the second end wall along the axis of rotation, the rotor further having a support shaft portion extending into the first end wall; and vanes fitted to the rotor;

wherein compressed air is supplied into the rotor chamber to rotationally drive the rotor by the compressed air, and the compressed air that has finished rotationally driving the rotor is discharged to an outside of the rotor chamber from a plurality of air discharge openings that open on the circular cylindrical inner peripheral surface;

the vane air motor further comprising:

a first radial bearing and a second radial bearing that are attached to the first end wall and the second end wall, respectively, to rotatably support the support shaft portion and the output shaft portion, respectively; and a casing contiguously joined to the motor housing to form a compressed air supply chamber together with the first end wall to supply compressed air into the rotor chamber through the first end wall;

the first end wall comprising:

an end wall portion having an inner end surface abutting against an end surface of the cylindrical wall to define the rotor chamber together with the circular cylindrical inner peripheral surface of the cylindrical wall and an outer end surface opposite to the inner end surface in an axial direction of the rotor, the end wall portion further having a circular cylindrical hole extending through the first end wall to receive the support shaft portion of the rotor therethrough; and a circular cylindrical wall portion extending from the outer end surface into the compressed air supply chamber opposite to the rotor chamber and defining a bearing-housing recess housing the first radial bearing, the circular cylindrical wall portion having an inner peripheral surface to which an outer peripheral surface of an outer race of the first radial bearing is securely fitted, the first radial bearing comprising the outer race, an inner race securely fitted to an outer peripheral surface of the support shaft portion in coaxial relation to the outer race, and a plurality of rolling members provided between the outer race and the inner race;

the first end wall having a communication groove extending from an end surface of the circular cylindrical wall portion to the outer end surface of the end wall portion along the inner peripheral surface of the cylindrical wall portion;

the air discharge openings being disposed such that each pair of the air discharge openings adjacent to each other in the axial direction overlap each other as seen in a circumferential direction of the motor housing;

wherein an air supply opening for supplying compressed air into the rotor chamber is provided to open on the circular cylindrical inner peripheral surface at a substantially central position in the axial direction of the cylindrical wall.

* * * * *